US005400915A

United States Patent [19]

Kennedy

[11] Patent Number: 5,400,915

[45] Date of Patent: Mar. 28, 1995

[54] CONTAINER WINDOW SEAL

[76] Inventor: Michael R. Kennedy, 7062 Hillcreek La., Gates Mills, Ohio 44040

[21] Appl. No.: 210,903

[22] Filed: Mar. 21, 1994

[51] Int. Cl.[6] ..... B65D 51/00

[52] U.S. Cl. ..... 220/377; 215/230; 206/45.31

[58] Field of Search ..... 220/357, 356, 377; 215/230; 229/125.13, 125.34, 125.35; 206/45.31

[56] References Cited

U.S. PATENT DOCUMENTS

| | | | |
|---|---|---|---|
| 3,122,990 | 3/1964 | Fried | 220/377 X |
| 3,342,367 | 9/1967 | Irland | 220/377 X |
| 4,964,563 | 10/1990 | Chaygneaud-Dupuy | 229/162 |
| 5,246,133 | 9/1993 | James | 220/377 |

*Primary Examiner*—Allan N. Shoap
*Assistant Examiner*—Nova Stucker
*Attorney, Agent, or Firm*—Watts, Hoffmann, Fisher & Heinke

[57] ABSTRACT

A seal for a container is described for sealing a product viewing window. In one embodiment, an opening is formed in the lid of a container. A barrier layer of transparent film is adhesively secured to the inside of the window. An outer layer of transparent film is adhesively secured to the outside of the barrier layer and the inside of the window. A label having a window formed in its middle is adhesively secured to the outside of the window and to the outside of the outer layer of film. Variations of the seal are described as alternate embodiments.

4 Claims, 3 Drawing Sheets

CONTAINER WINDOW SEAL

BACKGROUND OF THE INVENTION

1. Field of the Invention

This invention relates to a seal for a container, and more particularly, a laminar seal for a container opening which provides a viewing window for viewing the contents of the container.

2. Description of the Related Art

Food containers often have windows formed in their walls to enable a customer to view the contents. In particular, the lids of cylindrical ice cream containers are often provided with a window for viewing the ice cream inside the container. Among other things, this helps the buyer verify the flavor since ice cream flavors are usually associated with a color. Typically, container lids are opaque. Windows have been provided by punching a hole in the lids. Transparent seals have been placed over the windows and adhered to the lids. Problems such as seepage of melted ice cream around the seal, fogging of the window, and contact between the ice cream or other contained food and the adhesive have occurred with prior art container window seals. Customers will sometimes avoid purchasing a container of ice cream if there is an appearance of seepage around the window or if the window is hazy. A container window seal is needed for the food container industry which is simple and inexpensive to produce, prevents contact between food and adhesive, avoids seepage and provides a clear view of the container contents.

SUMMARY OF THE INVENTION

Basically, the invention is a seal for permitting viewing of the contents of a container through a window formed in the container. The seal includes a barrier layer of transparent film located between the window and the interior of the container. A layer of adhesive secures the tranparent film to an inner wall surface immediately surrounding the window.

BRIEF DESCRIPTION OF THE DRAWINGS

Preferred embodiments of the invention are shown in the accompanying drawings in which.

DESCRIPTION OF THE PREFERRED EMBODIMENTS

Figure 1:
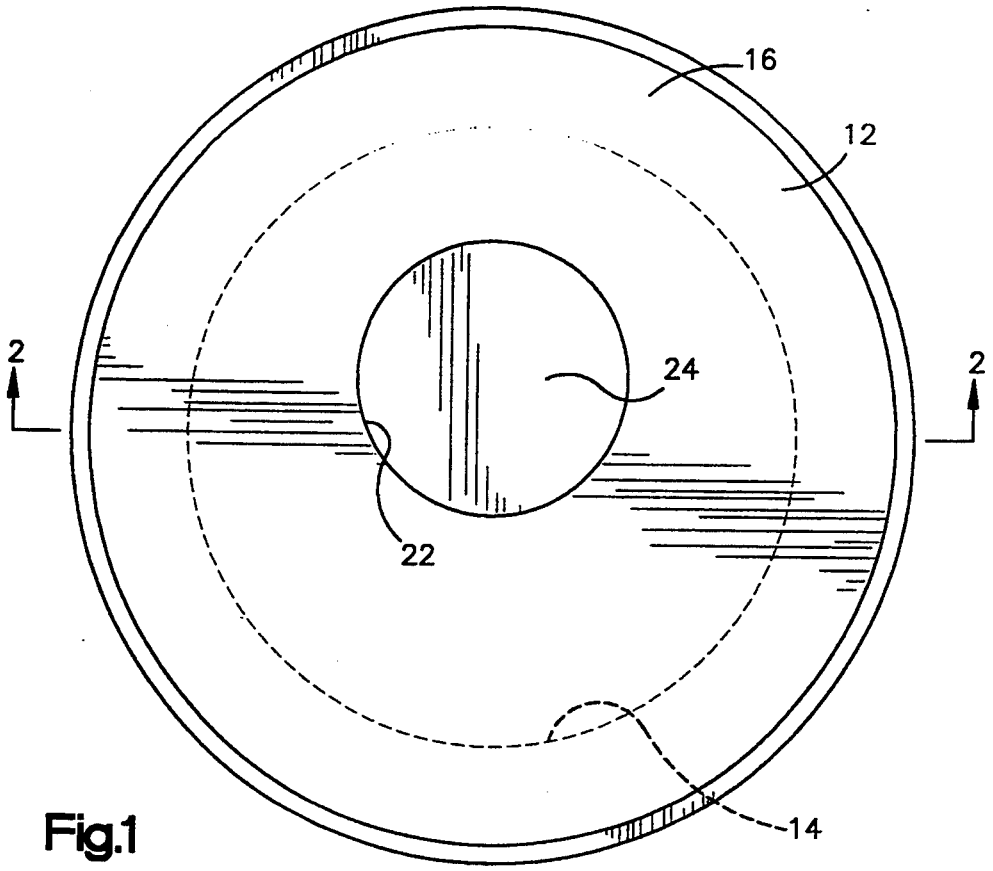
FIG. 1 is a top plan view of a container lid incorporating a window seal according to the invention.
Figure 2:
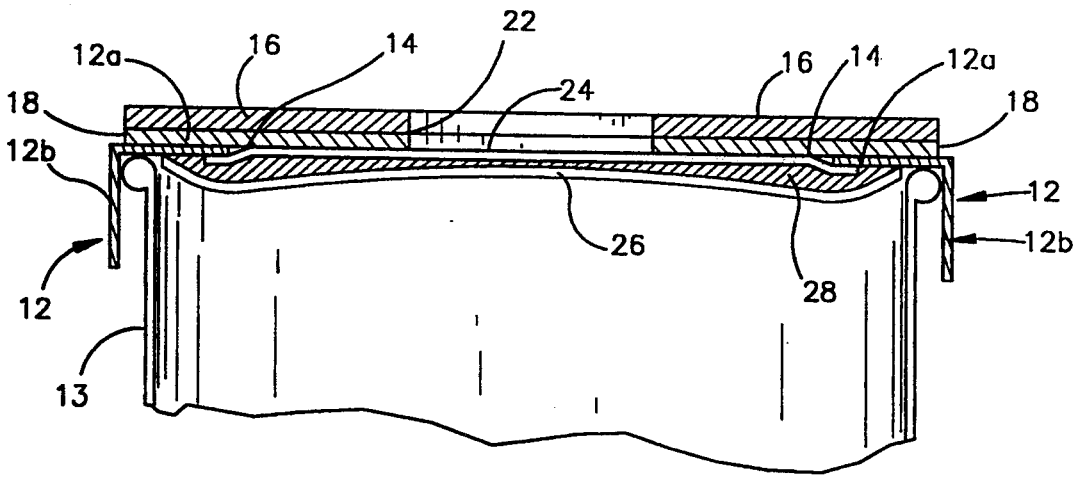
FIG. 2 is a cross sectional view as seen approximately from the plane indicated by the line 2—2 in FIG. 1 (layer thicknesses exaggerated)

The present invention has numerous applications. Referring to FIGS. 1 and 2, a first preferred and illustrated embodiment is a circular container lid 12 of a type used to seal cylindrical ice cream containers 13.

The container lid 12 includes annular portion 12*a* which has an opening 14 provided in a central portion of the lid 12, and a peripheral side portion 12*b* extending downwardly from the portion 12*a*. The lid 12 may be constructed of a number of materials including plastic, metal, and cardboard. An annular label 16 is positioned concentrically to the lid 12 and is secured to an upper surface of the annular portion 12*a* with an annular layer of adhesive 18. The contents of container 13 sealed with the lid 12 may be viewed through a window 22 which is formed by the concentric positioning of the label 16 and the adhesive 18 on the upper surface of annular portion 12*a*.

A first circular layer of transparent film 24 having a diameter larger than that of the opening 14 is positioned concentrically to the lid 12 against a lower surface of annular portion 12*a* of the lid 12 such that an outer annular area of the film 24 is in contact with an inner annular area of the lid 12 which surrounds the opening 22. A second circular layer of transparent film 26 having a diameter larger than the film layer 24 is positioned concentrically to the lid 12 so as to cover the first layer of film 24 and is secured to the lower surface of annular portion 12*a* and to the first layer of film 24 by a circular layer of transparent adhesive 28. Since the window 22 is covered with two transparent film layers 24,26, and with a transparent adhesive layer 28, the contents of container 13 can be clearly seen by prospective buyers. The lower film layer 26 serves as a barrier between the contents of the container and the adhesive 28. Thus, in the case of food contents, the lower film layer 26 prevents food from contacting the adhesive 28 and prevents liquids from seeping towards the window 22 which would lead to an unappealing appearance of window 22. The lower film layer 26 and adhesive layer 28 may be larger in diameter so as to extend outward to the peripheral side portion 12*b* of the lid 12 such that these layers form a seal between the lid 12 and the container 13.

The thicknesses of the layers in the cross sectional views are exaggerated so the separate layers can be viewed. However, the label layer 16 is approximately 2–3 thousandths of an inch thick, the adhesive layer 18 is approximately 0.5 thousandths of an inch thick, the upper film layer 24 is approximately 2–3 thousandths of an inch thick, the lower adhesive layer 28 is approximately 0.5 thousandths of an inch thick and the lower film layer 26 is approximately 2–3 thousandths of an inch thick. The lid 12 is approximately 3.5 to 5.5 thousandths of an inch thick.

Any of the layers, including the adhesive 28 may be printed on to identify the container, rather than labeling container 13 itself according to its contents or to add colors to the container. In the first preferred embodiment, the upper label 16 is printed on its upper surface with indicia relating to the contents of the container. By using the labels 16 for all the product labeling rather than the container 13 or the lid 12, the package can use generic containers and lids for all product varieties. Only the labels 16, which are less expensive to produce and store require special preparation.

The labels 16 and the transparent layers 24,26 may be manually applied to the lids 12 or they may be applied by a machine. The adhesives used are pressure sensitive and permanent and no heat is required to secure the first layers. Preferably, the label 16 and the upper adhesive 18 will be produced as a laminate adhered to a roll of release coated material (not shown) and the two film layers 24, 26 and the lower adhesive layer 28 will be produced as a laminate adhered to another roll of release coated material (not shown). Thus, the laminates may be readily peeled off of the release material and applied to the appropriate side of the lid 12.

Figure 3:
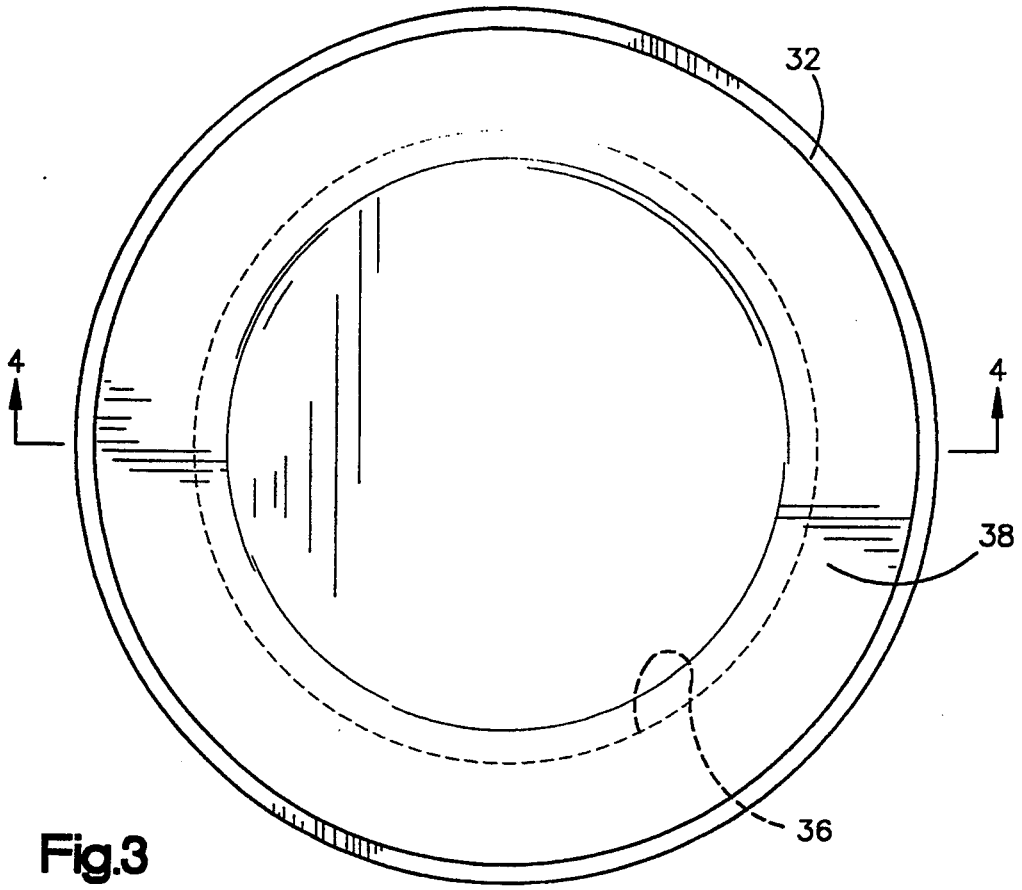
FIG. 3 is a top plan view of a container lid incorporating a second embodiment of a window seal according to the invention.
Figure 4:
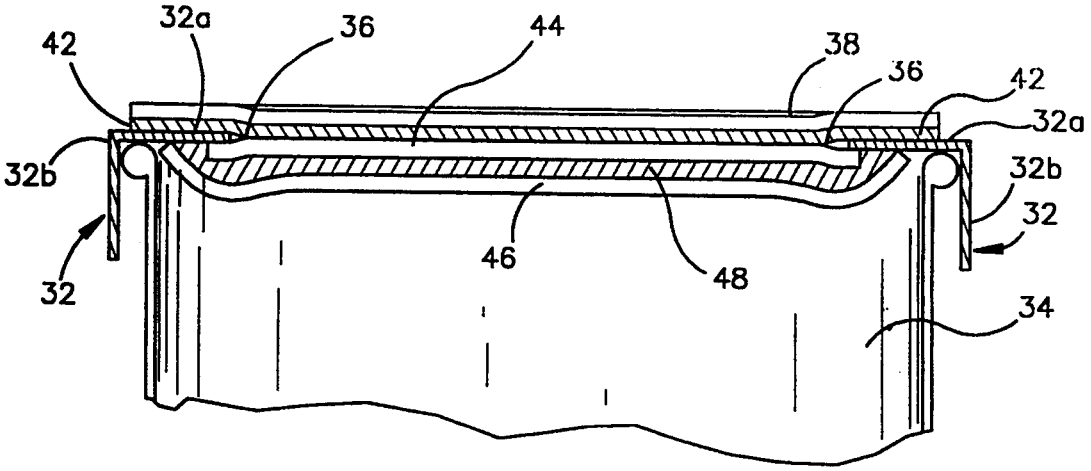
FIG. 4 is a cross sectional view as seen approximately from the plane indicated by the line 4—4 of FIG. 3 (layer thicknesses exaggerated)

FIGS. 3 and 4 illustrate a second embodiment of the container window seal of the invention. A lid 32 is shown for closing a cylindrical container 34. The lid 32 includes annular portion 32*a* which has a circular opening 36 provided in a central portion of the lid 32, and a peripheral side portion 32*b* extending downwardly from the portion 32*a*. An upper circular transparent film layer 38 is positioned concentrically to the lid 32 and is secured to an upper surface of the annular portion 32*a* by a circular layer of transparent adhesive 42. As distinguished from the embodiment of FIGS. 1 and 2, it is not necessary to punch a hole in the upper layers 38,42 because these layers are transparent and allow for viewing of the contents through the opening 36. A first circular layer of transparent film 44 having a diameter larger than that of the opening 36 is positioned concentrically against a lower surface of annular portion 32*a* such that an outer annular area of the film 44 is in contact with an inner annular area of the lid 32 which surrounds the opening 36. A second lower circular transparent film layer 46 having a diameter larger than the film 44 is positioned concentrically to the lid 32 so as to cover the first layer of film 44 and is secured to the lower surface of annular portion 32*a* and to the first layer of film 44 with a layer of adhesive 48. The lower film layer 46 and the adhesive layer 48 may be larger in diameter to extend outward to the peripheral side portion 32*b* of the lid 32 to form a seal between the lid 32 and the container 34.

Indicia may be printed on any of the layers 38, 42, 44, 46, or 48 to identify the container 34 according to its contents rather than labeling container 34 itself. Also colors may be printed on any of the layers. As in the first embodiment, the layers 38,42 applied to the upper surface of the annular portion 32*a* of the lid 32 are preferably provided as a laminate adhered on a roll of release coated material. The layers 44, 46, 48 applied to the annular portion 32*a* of the lower surface of the lid 32 are preferably provided as a laminate adhered to a second roll of release coated material.

Figure 5:
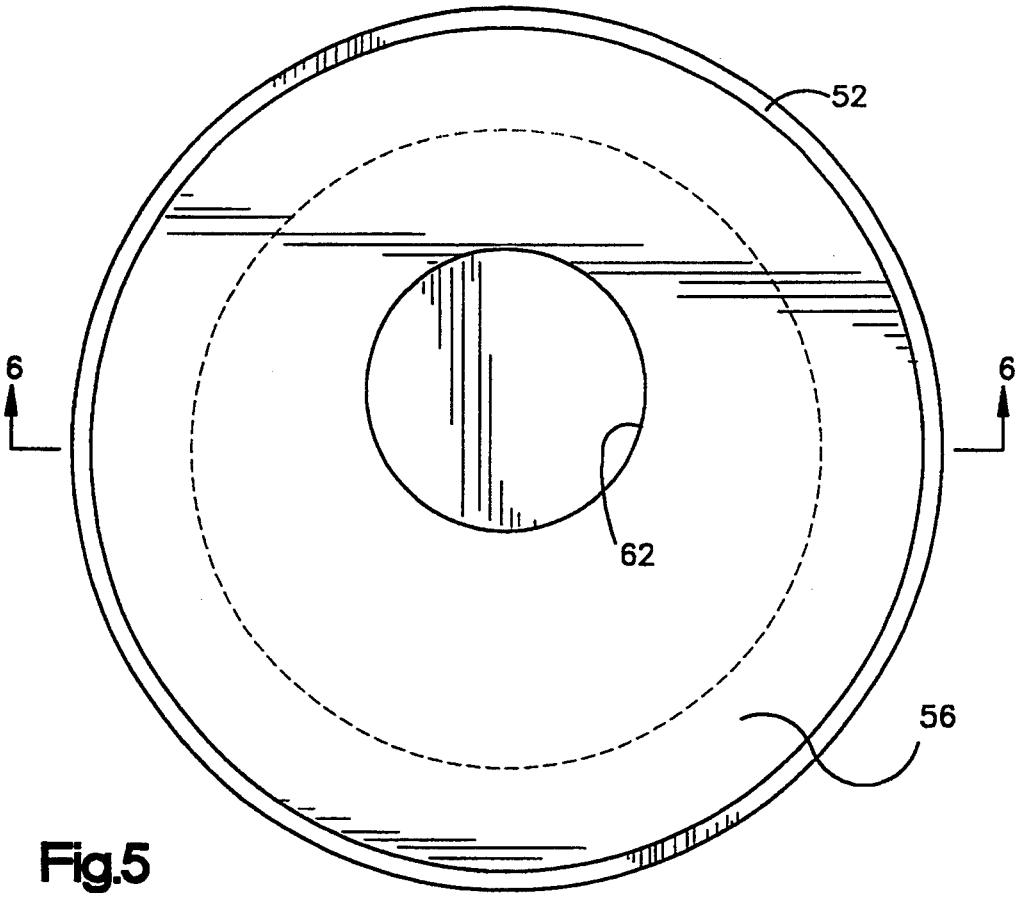
FIG. 5 is a top plan view of a container lid incorporating a third embodiment of a window seal according to the invention.
Figure 6:
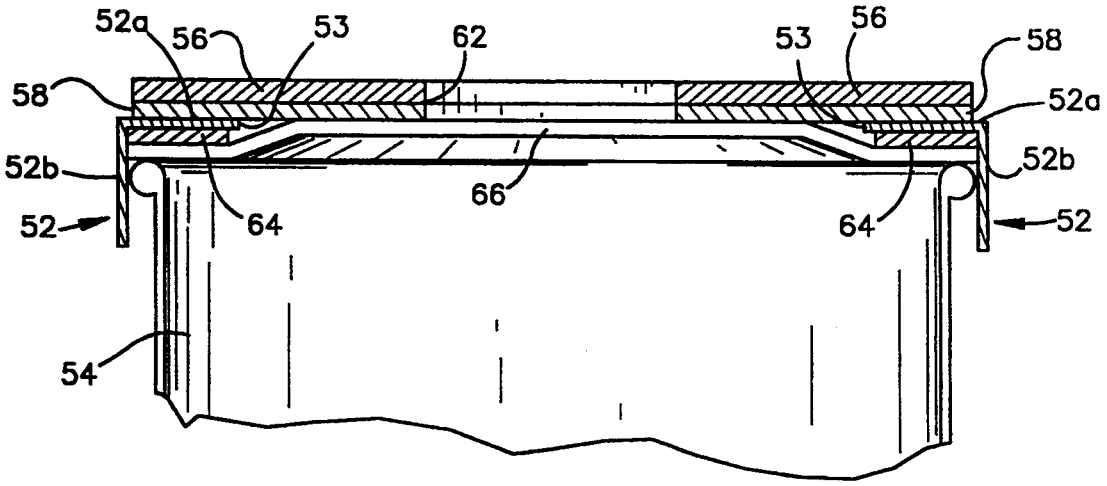
FIG. 6 is a cross sectional view as seen approximately from the plane indicated by the line 6—6 of FIG. 5 (layer thicknesses exaggerated).

FIGS. 5 and 6 illustrate a third embodiment of the widow seal of the present invention. A lid 52 is shown fitted on a cylindrical container 54. The lid 52 includes annular portion 52*a* which has a circular opening 53 provided in a central portion of the lid 52, and a peripheral side portion 52*b* extending downwardly from the portion 52*a*. An annular label 56 is provided concentrically to the lid 52 and is secured to an upper surface of the annular portion 52*a* of the lid 52 with an annular layer of adhesive 58. A window 62 is formed by the concentric positioning of the label 56 and the adhesive 58 to permit viewing of the contents of the container 54. Alternatively, a circular transparent film layer and a transparent adhesive layer may be applied to the upper surface of the annular portion 52*a* of the lid 52 (like 38,42 shown in FIG. 4), which would allow viewing without the necessity of forming a window 62.

As shown in FIG. 6, a ring of adhesive 64 is applied to the lower surface of the annular portion 52*a* of the lid 52 to concentrically secure a transparent circular layer of film 66 to the lid 52. The lower film 66 and its adhesive layer 64 may be smaller in diameter so as to avoid contact with the container 54 as long as the ring of adhesive 64 is sufficiently wide to secure the lower film layer 66 to the lid 52. Similar to the previously described embodiments, the label 56 and the adhesive layer 58 are preferably formed as a laminate on a roll of release material, and the lower film layer 66 and the adhesive ring 64 are preferably provided on a separate roll of release coated material for easy handling of the materials. Any of the layers 56, 58, 64, or 66 may be printed with colors or labeling indicia.

While preferred embodiments of this invention have been described in detail, it will be apparent that certain modifications or alterations can be made without departing from the spirit and scope of the invention set forth in the appended claims.

I claim:

1. In a container having a viewing window covered by transparent window film for permitting viewing of the container contents, the improvement comprising:

a barrier layer of transparent film located between said window film and the interior of said container; and a layer of adhesive securing the film of barrier layer to an inner wall surface surrounding said window;

a portion of said adhesive being sandwiched between said barrier layer film and said winding film.

2. The improvement according to claim 1, further including a label secured by adhesive to an outer wall surface surrounding said window.

3. The improvement according to claim 2, wherein the label has an annular shape such that an opening provided in its central portion is aligned with said window.

4. The improvement according to claim 2, wherein the label and the layer of adhesive securing the label are transparent.

* * * * *